US007612606B2

(12) United States Patent
Marinca

(10) Patent No.: US 7,612,606 B2
(45) Date of Patent: Nov. 3, 2009

(54) LOW VOLTAGE CURRENT AND VOLTAGE GENERATOR

(75) Inventor: Stefan Marinca, Dooradoyle (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 12/005,013

(22) Filed: Dec. 21, 2007

(65) Prior Publication Data

US 2009/0160538 A1 Jun. 25, 2009

(51) Int. Cl.
*G05F 1/10* (2006.01)

(52) U.S. Cl. ..... 327/539

(58) Field of Classification Search ..... 323/313; 327/535, 537, 539
See application file for complete search history.

(56) References Cited

U.S. PATENT DOCUMENTS

| | | | |
|---|---|---|---|
| 4,399,398 | A | 8/1983 | Wittlinger |
| 4,475,103 | A | 10/1984 | Brokaw et al. |
| 4,603,291 | A | 7/1986 | Nelson |
| 4,714,872 | A | 12/1987 | Traa |
| 4,800,339 | A | 1/1989 | Tanimoto et al. |
| 4,808,908 | A | 2/1989 | Lewis et al. |
| 4,939,442 | A | 7/1990 | Carvajal et al. |
| 5,053,640 | A | 10/1991 | Yum |
| 5,119,015 | A | 6/1992 | Watanabe |
| 5,229,711 | A | 7/1993 | Inoue |
| 5,325,045 | A | 6/1994 | Sundby |
| 5,352,973 | A | 10/1994 | Audy |
| 5,371,032 | A | 12/1994 | Nishihara |
| 5,424,628 | A | 6/1995 | Nguyen |
| 5,512,817 | A | 4/1996 | Nagaraj |
| 5,563,504 | A | 10/1996 | Gilbert et al. |
| 5,646,518 | A | 7/1997 | Lakshmikumar et al. |
| 5,821,807 | A | 10/1998 | Brooks |
| 5,828,329 | A | 10/1998 | Burns |
| 5,933,045 | A | 8/1999 | Audy et al. |

(Continued)

FOREIGN PATENT DOCUMENTS

| | | |
|---|---|---|
| EP | 0510530 | 10/1992 |

(Continued)

OTHER PUBLICATIONS

PCT/EP2008/058685 International Search Report and written opinion, Oct. 1, 2008.

(Continued)

*Primary Examiner*—Jeffrey S Zweizig
(74) *Attorney, Agent, or Firm*—Wolf, Greenfield & Sacks, P.C.

(57) ABSTRACT

A bandgap reference circuit which is operable in low supply conditions is described. Such a circuit includes a second amplifier and a resistor at the output of a bandgap reference cell to create a constant current summing node at which PTAT and CTAT currents are summed. In modifications to the circuit it is possible to also provide a voltage reference node corresponding to the signal provided at the summing node. A further modification enables generation of a second voltage reference whose value is related to the base emitter voltage Vbe of a bipolar transistor. Further modifications provided for the generation of curvature correction within the circuit by biasing each of the first and second bipolar transistors Q1 and Q2 with currents of different forms.

18 Claims, 5 Drawing Sheets

U.S. PATENT DOCUMENTS

| | | | | |
|---|---|---|---|---|
| 5,952,873 | A | 9/1999 | Rincon-Mora | |
| 5,982,201 | A | 11/1999 | Brokaw et al. | |
| 6,002,293 | A | 12/1999 | Brokaw | |
| 6,075,354 | A | 6/2000 | Smith et al. | |
| 6,157,245 | A | 12/2000 | Rincon-Mora | |
| 6,218,822 | B1 | 4/2001 | MacQuigg | |
| 6,225,796 | B1 | 5/2001 | Nguyen | |
| 6,255,807 | B1 | 7/2001 | Doorenbos et al. | |
| 6,329,804 | B1 | 12/2001 | Mercer | |
| 6,329,868 | B1 | 12/2001 | Furman | |
| 6,356,161 | B1 | 3/2002 | Nolan et al. | |
| 6,362,612 | B1 | 3/2002 | Harris | |
| 6,373,330 | B1 | 4/2002 | Holloway | |
| 6,426,669 | B1 | 7/2002 | Friedman et al. | |
| 6,462,625 | B2 | 10/2002 | Kim | |
| 6,483,372 | B1 | 11/2002 | Bowers | |
| 6,489,787 | B1 | 12/2002 | McFadden | |
| 6,489,835 | B1 | 12/2002 | Yu et al. | |
| 6,501,256 | B1 | 12/2002 | Jaussi et al. | |
| 6,529,066 | B1 | 3/2003 | Guenot et al. | |
| 6,531,857 | B2 | 3/2003 | Ju | |
| 6,549,072 | B1 | 4/2003 | Vernon | |
| 6,590,372 | B1 | 7/2003 | Wiles, Jr. | |
| 6,614,209 | B1 | 9/2003 | Gregoire, Jr. | |
| 6,642,699 | B1 | 11/2003 | Gregoire, Jr. | |
| 6,661,713 | B1 | 12/2003 | Kuo | |
| 6,664,847 | B1 | 12/2003 | Ye | |
| 6,690,228 | B1 | 2/2004 | Chen et al. | |
| 6,791,307 | B2 | 9/2004 | Harrison | |
| 6,798,286 | B2 | 9/2004 | Dauphinee et al. | |
| 6,801,095 | B2 | 10/2004 | Renninger, II | |
| 6,828,847 | B1 | 12/2004 | Marinca | |
| 6,836,160 | B2 | 12/2004 | Li | |
| 6,853,238 | B1 | 2/2005 | Dempsey et al. | |
| 6,885,178 | B2 | 4/2005 | Marinca | |
| 6,891,358 | B2 | 5/2005 | Marinca | |
| 6,894,544 | B2 | 5/2005 | Gubbins | |
| 6,919,753 | B2 | 7/2005 | Wang et al. | |
| 6,930,538 | B2 * | 8/2005 | Chatal | 327/539 |
| 6,958,643 | B2 | 10/2005 | Rosenthal | |
| 6,987,416 | B2 | 1/2006 | Ker et al. | |
| 6,992,533 | B2 | 1/2006 | Hollinger et al. | |
| 7,012,416 | B2 | 3/2006 | Marinca | |
| 7,057,444 | B2 | 6/2006 | Illegems | |
| 7,068,100 | B2 | 6/2006 | Dauphinee et al. | |
| 7,088,085 | B2 | 8/2006 | Marinca | |
| 7,091,761 | B2 | 8/2006 | Stark | |
| 7,112,948 | B2 | 9/2006 | Daly et al. | |
| 7,170,336 | B2 | 1/2007 | Hsu | |
| 7,173,407 | B2 | 2/2007 | Marinca | |
| 7,193,454 | B1 | 3/2007 | Marinca | |
| 7,199,646 | B1 * | 4/2007 | Zupcau et al. | 327/539 |
| 7,211,993 | B2 | 5/2007 | Marinca | |
| 7,224,210 | B2 * | 5/2007 | Garlapati et al. | 327/539 |
| 7,236,047 | B2 | 6/2007 | Tachibana et al. | |
| 7,248,098 | B1 | 7/2007 | Teo | |
| 7,260,377 | B2 | 8/2007 | Burns et al. | |
| 7,301,321 | B1 | 11/2007 | Uang et al. | |
| 7,372,244 | B2 | 5/2008 | Marinca | |
| 7,411,380 | B2 | 8/2008 | Chang et al. | |
| 7,472,030 | B2 | 12/2008 | Scheuerlein | |
| 7,482,798 | B2 | 1/2009 | Han | |
| 2003/0234638 | A1 * | 12/2003 | Eshraghi et al. | 323/315 |
| 2005/0073290 | A1 | 4/2005 | Marinca et al. | |
| 2005/0194957 | A1 | 9/2005 | Brokaw | |
| 2006/0017457 | A1 | 1/2006 | Pan et al. | |
| 2007/0176591 | A1 | 8/2007 | Kimura | |
| 2008/0074172 | A1 | 3/2008 | Marinca | |
| 2008/0224759 | A1 | 9/2008 | Marinca | |
| 2008/0265860 | A1 | 10/2008 | Dempsey et al. | |

FOREIGN PATENT DOCUMENTS

| | | | |
|---|---|---|---|
| EP | 1359490 | A2 | 11/2003 |
| EP | 1359490 | A3 | 11/2003 |
| JP | 4-167010 | | 6/1992 |
| WO | WO 2004/007719 | | 2/2004 |

OTHER PUBLICATIONS

PCT/EP2008/051161 International Search Report and written opinion, May 16, 2008.

Chen, Wai-Kai, "The circuits and filters handbook", 2nd ed, CRC Press, 2003.

Cressler, John D., "Silicon Heterostructure Handbook", CRC Press-Taylor & Francis Group, 2006; 4.4-427-438.

Gray, Paul R., et al, *Analysis and Design of Analog Integrated Circuits*, Chapter 4, 4th ed., John Wiley & Sons, Inc., 2001, pp. 253-327.

PCT/EP2005/052737 International Search Report, Sep. 23, 2005.

Banba et al, "A CMOS bandgap reference circuit with Sub-1-V operation", IEEE JSSC vol. 34, No. 5, May 1999, pp. 670-674.

Brokaw, A. Paul, "A simple three-terminal IC bandgap reference", IEEE Journal of Solid-State Circuits, vol. SC-9, No. 6, Dec. 1974, pp. 388-393.

Jones, D.A., and Martin, K., "Analog Integrated Circuit Design", John Wiley & Sons, USA, 1997 (ISBN 0-47L-L4448-7, pp. 353-363).

Malcovati et al, "Curvature-compensated BiCMOS bandgap with 1-V supply voltage", IEEE JSSC, vol. 36, No. 7, Jul. 2001.

Sudha et al, "A low noise sub-bandgap voltage reference", IEEE, Proceedings of the 40th Midwest Symposium on Circuits and Systems, 1997. vol. 1, Aug. 3-6, 1997, pp. 193-196.

Widlar, Robert J., "New developments in IC voltage regulators", IEEE Journal of Solid-State Circuits, vol. SC-6, No. 1, Feb. 1971, pp. 2-7.

Jianping, Zeng, et al, "CMOS Digital Integrated temperature Sensor", IEEE, Aug. 2005, pp. 310-313.

PCT/EP2008/067403, International Search Report and Written Opinion, Apr. 27, 2009.

Pease, R.A., "The design of band-gap reference circuits: trials and tribulations", IEEE 1990 Bipolar circuits and Technology Meeting 9.3, Sep. 17, 1990, pp. 214-218.

* cited by examiner

LOW VOLTAGE CURRENT AND VOLTAGE GENERATOR

FIELD OF THE INVENTION

The invention relates to bandgap voltage references and particularly to bandgap voltage circuits operable in low supply voltage environments.

BACKGROUND

Bandgap voltage references and temperature dependent or temperature independent bias current generators are widely used in integrated circuits and have application in both bipolar and CMOS processes. Ultimately it will be understood that any bandgap based voltage or current generator provides for a combination of a Proportional To Absolute Temperature (PTAT) signal with a Complementary To Absolute Temperature (CTAT) signal. In bandgap voltage reference a base-emitter voltage of a bipolar transistor (which is CTAT) is added to a PTAT voltage generated from a base-emitter voltage difference of at least two bipolar transistors operating at different collector current density. In constant current generators or in current mode bandgap voltage generators two currents, one of the form of a PTAT current and one of the form of a CTAT current, are combined to generate a desired output current or voltage. In the design of such circuits operation at low power supply is desired.

An example of a known low voltage bandgap voltage reference implemented in CMOS process is presented in FIG. 1. It includes three substrate bipolar transistors, Q1, Q2, Q3 four PMOS transistors, M1, M2, M3, M4, two NMOS transistors, M5, M6, one amplifier, A, and two resistors, R1, R2. The amplifier A effects a forcing of the common gate of M1 to M4 such that its two inputs have substantially the same voltage which is the base-emitter voltage of bipolar transistor operating at lower current density, Q2. As the bipolar transistors coupled to each of the two input terminals of the amplifier are operable at different current densities, abase emitter voltage difference ΔVbe is generated. This base-emitter voltage difference ΔVbe between the bipolar transistors Q1 and Q2 is reflected across R1 which is coupled between the non-inverting terminal of the amplifier and Q1. The base emitter voltage of Q1 provides a base emitter voltage Vbe. Thus, the reference voltage at the output node $V_{ref}$ is a combination of the ΔVbe across R1 and the Vbe of Q1. The circuit of FIG. 1 implemented in a typical submicron CMOS process can operate at a supply voltage of less than 1.5V. It can generate both a voltage reference and PTAT current reference.

Another example of a known prior art circuit configured to generate a constant current or with a predetermined temperature output voltage or current is presented in FIG. 2. The circuit of FIG. 2 is based on two bipolar transistors; a first QP1, operating with high current density, and the second, QP2, operating with low current density. Their base-emitter voltage difference ΔVbe, which is a signal of the form of a proportional to absolute temperature PTAT signal, is reflected across a resistor R3 coupled between QP2 and the inverting terminal of the operational amplifier, A1. As the amplifier A1 operably controls its two inputs to be at substantially the same voltage level and similarly to the circuit of FIG. 1, the input to the amplifier A1 has a voltage level corresponding to the base-emitter voltage Vbe of the bipolar transistor QP1 operating with higher base-emitter voltage. This has a form of a complementary to absolute temperature, CTAT, signal. The drains of the two PMOS transistors MP2, MP3 are each coupled to a corresponding one of the inverting and non-inverting terminals of the amplifier A1. Each PMOS transistor MP2 and MP3 have substantially identical aspect ratios W/L and have their gates coupled to ground which results in the drains currents being PTAT in nature. A second amplifier A2 is provided having its inverting terminal coupled to the non-inverting terminal of the first amplifier A1. A feedback path from the second amplifier A2 is coupled to each of the MOS devices MP2, MP3 and forms a common summing node "f". At the summing node "f" three currents are summed together, two PTAT currents, from MP2 and MP3,respectively, and one CTAT current, as the second amplifier A2 operably forces the base-emitter voltage across a resistor R4 via MOS device MP6, provided at the output of the amplifier A2. As a result the current via PMOS transistor MP1 has a temperature dependence relating to the mixture of PTAT and CTAT currents. While the circuit of FIG. 1 operates at a lower supply voltage to the circuit of FIG. 2, it suffers in that it can generate only PTAT currents. The circuit of FIG. 2 is operable to generate a current with desired temperature behaviour but requires a larger supply voltage compared to the circuit of FIG. 1 as the PMOS transistor MP1 forms a cascoded arrangement with each of PMOS transistors MP2 and MP3. Similarly, MP4 and MP5 are in a cascoded arrangement. It will be appreciated by those skilled in the art that transistors in a cascoded arrangement requires a high biasing voltage than an uncascoded arrangement.

There is therefore a need for a circuit that can operate in lower voltage supply environments but yet has a desired temperature behaviour.

SUMMARY

Accordingly the invention provides a bandgap reference circuit which is operable in low supply conditions. Such a circuit includes a second amplifier and a resistor at the output of a bandgap reference cell to create a constant current summing node at which PTAT and CTAT currents are summed. In modifications to the circuit it is possible to also provide a voltage reference node corresponding to the signal provided at the summing node. A further modification enables generation of a second voltage reference whose value is related to the base emitter voltage Vbe of a bipolar transistor. Further modifications provided for the generation of curvature correction within the circuit by biasing each of the first and second bipolar transistors Q1 and Q2 with currents of different forms.

These and other features will be better understood with reference to the following drawings which will assist in an understanding of the teaching of the invention but which are not intended to be limiting in any fashion.

DETAILED DESCRIPTION OF THE DRAWINGS

Exemplary implementations of circuits provided in accordance with the teaching of the invention are now described with reference to FIGS. 3 to 5. Such circuits are adapted to generate an output current with desired temperature behaviour, and are also operable at low supply current.

Figure 1:
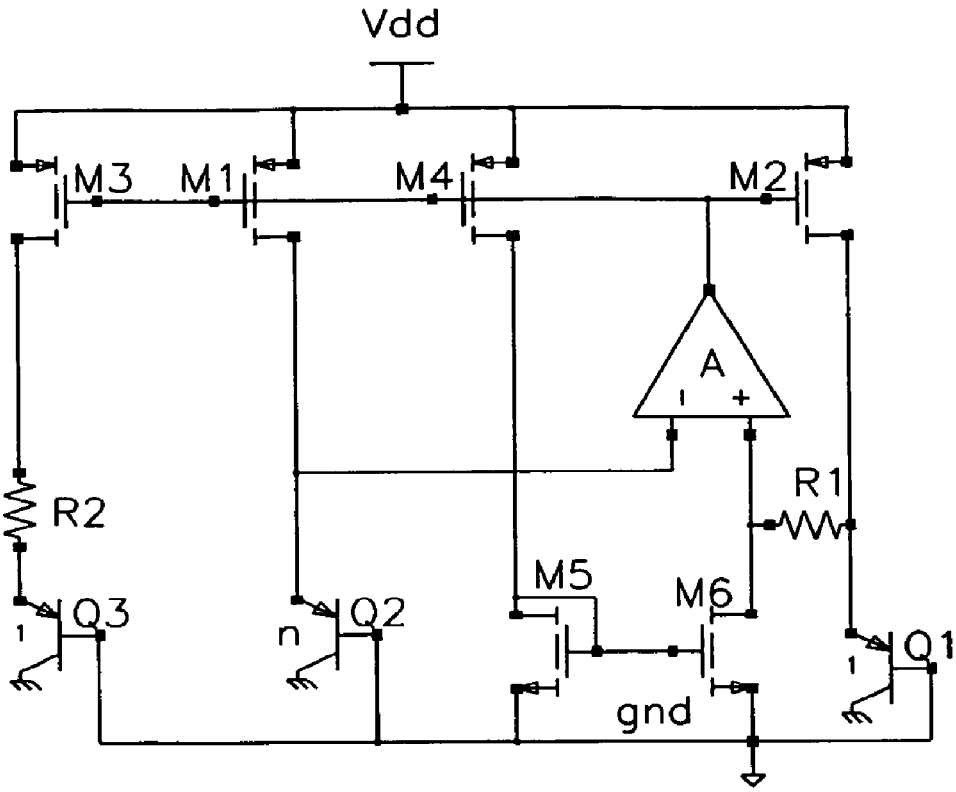
Fig.1 Prior Art
FIG. 1 is an example of a known bandgap circuit.
Figure 2:
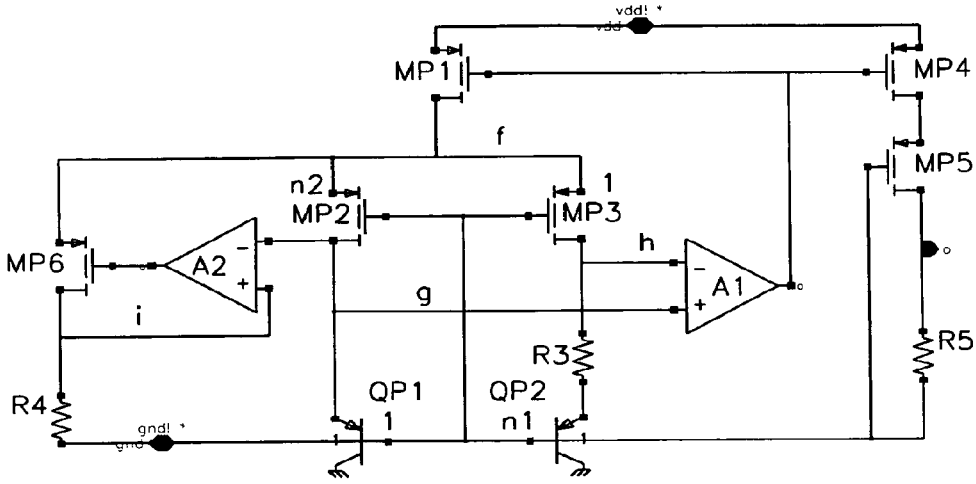
Fig.2 Prior Art
FIG. 2 is an example of a known modification to the circuit of FIG. 1 to provide for different temperature characteristics.
Figure 3:
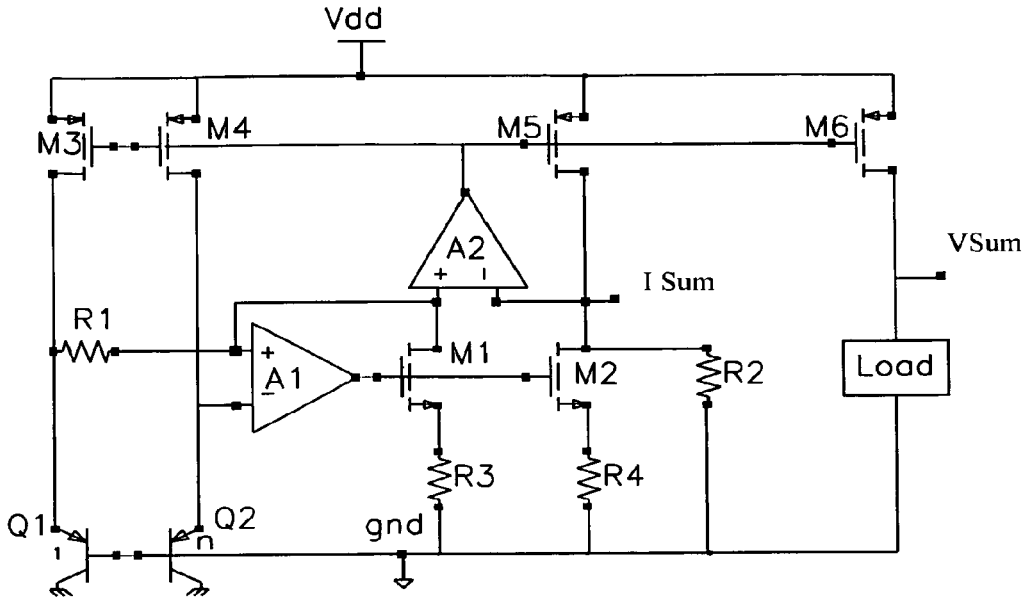
FIG. 3 is an example of a circuit provided in accordance with the teaching of the present invention.

A first example of such a circuit is presented in FIG. 3. Such a circuit includes a first amplifier A1 having an inverting terminal, a non-inverting terminal and an output terminal. Coupled to each of the two input terminals of the amplifier A1 are first Q1 and second Q2 bipolar transistors which are operable at different current densities such that a difference in base emitter voltages ΔVbe between each of the first and second transistors is generated across a resistor R1 provided to the non-inverting input leg of the amplifier. This voltage difference has a proportional to absolute temperature PTAT form. The output from the amplifier which drives M1 and M2 forces PTAT drain currents for each of M1 and M2.

The first transistor Q1 which is operable at the lower current density is coupled via the resistor R1 to the non-inverting input of the amplifier whereas the second transistor Q2, operable at the higher current density, is coupled directly to the inverting input of the amplifier. The voltage at the input to the amplifier is therefore related to the base emitter voltage Vbe of this second transistor Q1 and has a complementary to absolute temperature CTAT form.

A second amplifier A2 also having an inverting terminal, a non-inverting terminal and an output terminal is provided, the non-inverting terminal being coupled to the non-inverting terminal of the first amplifier A1. As a result the CTAT voltage Vbe at the input to the first amplifier A1 is reflected at the inputs of the second amplifier A2.

The inverting input of the second amplifier is coupled with the output of the first amplifier via the MOS devices MI and M2. The two MOS devices M1, M2 are desirably provided having the same aspect ratio W/L. Two degeneration resistors R3, R4 are also provided and are coupled between the sources of the two MOS devices M1, M2 and ground respectively. Each of the degeneration resistors R3, R4 are desirably provided having the same value. This will be understood as representing a preferred but not essential arrangement in that by scaling the MOS devices M1, M2 and their associated resistors R3, R4 to one another different scaled currents could be generated. The drains of the two MOS devices M1, M2 are coupled to each of the non-inverting and inverting inputs to the amplifier respectively.

The inverting input of the second amplifier A2 is also coupled via a first mirror arrangement provided by MOS devices M5, M4, M3 to the inputs to the first amplifier A1. The drain of the MOS device M5 is coupled to the inverting input of the second amplifier A2 and also to the drain of the second MOS device M2. It is also coupled to ground via a load resistor R2. It will be understood that assuming the MOS devices M1 and M2 have the same aspect ratio and the degeneration resistors R3 and R4 have the same value then the amplifier A1 forces the base-emitter voltage difference ΔVbe between Q1 and Q2 across resistor R1. As a result the drain currents of M1 and M2 are PTAT currents. All input voltages of A1 and A2 have substantially the same voltage level, which is base-emitter voltage Vbe of Q2 such that the voltage developed across R2 is the Vbe voltage which results in a CTAT current flowing through the load resistor R2. A summing node, I Sum, is therefore provided where this CTAT current which flows through R2 is summed with the PTAT current provided at the drain of M2. In this way the summed current at the summing node is derived from the CTAT and PTAT voltages.

A second mirroring arrangement is effected by coupling the gate of MOS device M5 to the gate of MOS device M6, which again is desirably provided having the same aspect ratio. As a consequence the drain current of M6 is substantially identical to the drain current of M5 which is equal to the current at the summing node. The drain current of M6 therefore is a constant current made up of a PTAT current and a CTAT current which flows through the load across which a constant voltage, V Sum, is developed. The voltage reference, and the originating current reference, can be scaled by scaling the relative values of the first and second resistors R1 and R2.

As M3, M4, M5 and M6 have the same gate-source voltage they will provide substantially identical drain currents. In this way although they are detailed as being first and second current mirrors, they provide the same mirroring of the current from the drain of M5 which is equal to the summed current. Depending on the resistor ratio of R2/R1, the drain currents of M3 to M6 can be provided as constant currents or with desired temperature behaviour. Assuming that the output is a constant current it will be understood that a constant current is provided at each of the drains of M3, M4, M5, M6 with the result that the first and second bipolar transistors Q1 and Q2 are biased with a constant current substantially equal to the summed current. It will be understood that the biasing of the first and second bipolar transistors Q1 and Q2 with a constant current provides for no compensation for second order temperature curvature effects but a modification to the circuit of FIG. 3 to provide for such correction will be discussed later.

It will be understood that the value of the constant current/voltage nodes of FIG. 3 are not directly related to the value of the base emitter voltage of the first bipolar Q1. FIG. 4 shows a modification of the circuitry of FIG. 3 which can generate simultaneously a voltage, Vref which is based on the base emitter voltage value of a bipolar, and an output current with a predetermined temperature behaviour.

Figure 4:
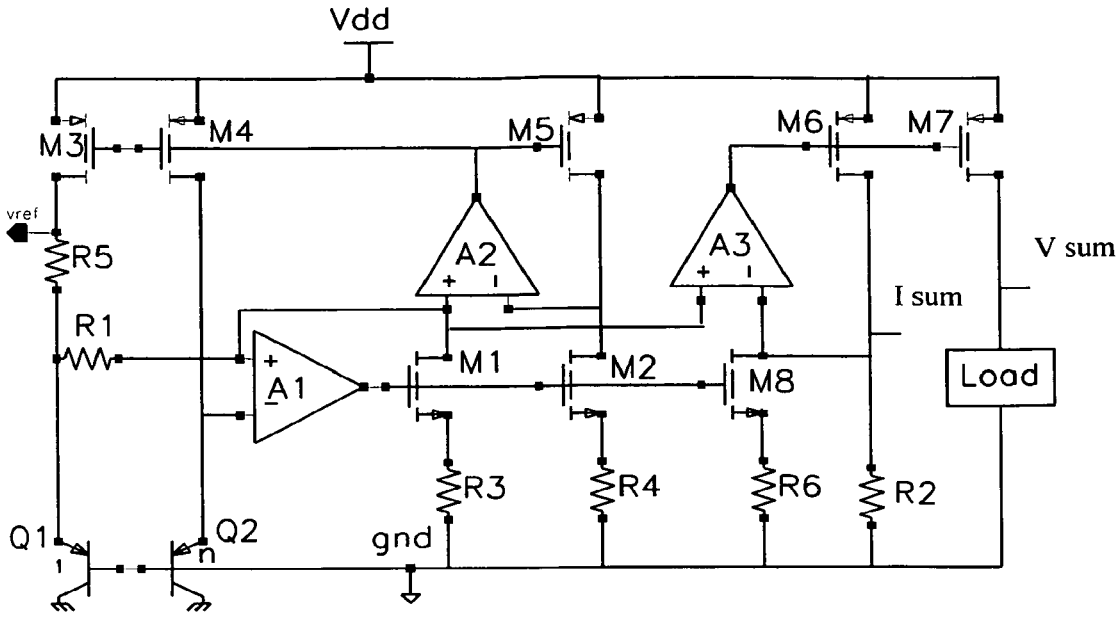
FIG. 4 shows a modification to the circuit of FIG. 3.
Figure 5:
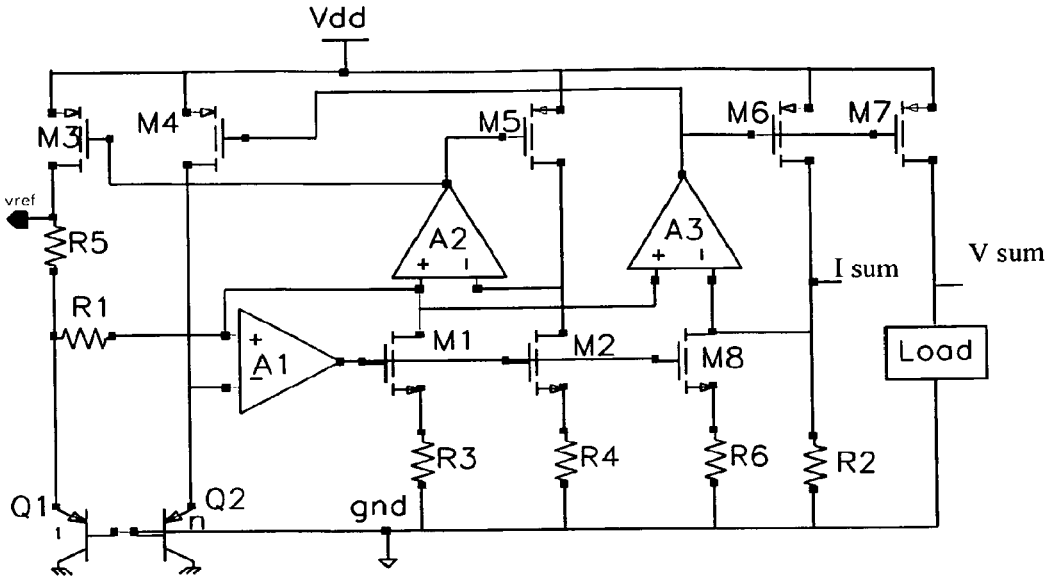
FIG. 5 shows a modification to the circuit of FIG. 4.

Referring now to FIG. 4, similarly to that described with reference to FIG. 3, the drain currents of MOS devices M1 and M2 are operating with PTAT currents. However whereas in the circuit of FIG. 3, the load resistor R2 was coupled to the drain of M2 so as to provide a CTAT current which was summed with the PTAT current provided by M2 to generate the constant current at the summing node, in this arrangement of FIG. 4 an additional sub-circuit is provided and the summing node is provided as part of that sub-circuit. In this way the drain of MOS device M5 is biased with a PTAT form derived from the drain current of MOS device M2 such that a corresponding PTAT current is mirrored by MOS devices M3, M4 and M5 to bias the first and second bipolar transistors Q1 and Q2. A load resistor R5 across which a PTAT voltage is developed resulting from the drain current of M3 is provided in the non-inverting leg between the drain of MOS device M3 and the first bipolar Q1. A voltage reference node between R5 and the drain M2 provides an output voltage whereby the PTAT voltage developed across R5 is summed with a CTAT voltage provided by the base emitter voltage Vbe of the bipolar device Q1 to generate the voltage reference.

As was mentioned above, whereas in the circuit of FIG. 3, the current at the summing node was directly mirrored using the current mirror of MOS devices M5, M6, in this circuit of FIG. 4, an additional sub-circuit is provided. The sub-circuit consists of a NMOS transistor, M8, two PMOS transistors, M6, M7, one amplifier, A3, and two resistors, R2, R6. The non-inverting input of the third amplifier A3 is coupled to the drain of MOS device M1 and the non-inverting input of the second amplifier A2. Whereas in the circuitry of FIG. 3 the drain of the MOS device M2 was coupled to the second resistor R2, the drain of the MOS device M5 and the inverting input of the second amplifier A2 such that the summing node was at the drain of the second MOS device M2, in this arrangement the additional MOS device M8, which is at the same gate potential as M2 and M1, is coupled at its drain to the inverting input of amplifier A3 and across load device R2 to ground. The summing node ISum, has therefore been transferred across to the common node of the drain of MOS device M8, the inverting input of the third amplifier A3, the drain of MOS device M6 and the resistor R2. Similarly to that described with reference to FIG. 3, a CTAT voltage ΔVbe is developed across the resistor R2 derived from Q1 which result in a CTAT current flowing through R2 which sums with the PTAT current at the summing node resulting in a constant current which is mirrored by M6 and M7. Thus the drain current of M7 is a constant current, the summed current, which is reflected across the load to develop a reference voltage VSum. The temperature dependence of the current injected from M7 into the load corresponds to the resistor ratio R2/R1.

It will be appreciated that in the arrangement of FIG. 3, the first and second bipolar transistors were biased with a constant current whereas in FIG. 4 they are both biased with a PTAT current. The reference voltage provided by the circuit of FIG. 4 at the output node Vref has a typical second order non-linear voltage error of the form TlogT. This second order effect is commonly called a curvature error. This error can be minimised if the two bipolar transistors, Q1, Q2 are biased differently, Q1 with PTAT current and Q2 with constant current. FIG. 5 shows how by providing currents of this form it is possible to generate a "curvature" corrected voltage reference and a temperature independent output current. In the circuit modification of FIG. 5, the gate of MOS device M3 is coupled directly to the output of the second amplifier A2, whereas the gate of MOS device M4 is coupled to the output of the third amplifier A3. In this way the drain current of M4 is of the form of a constant current, derived from the constant current summing node, whereas the drain of M3 has a PTAT form derived from the drain current of MOS device M2. By biasing each of the first and second bipolar transistors Q1, and Q2 with current of a different form, a second order curvature correction is effected.

It will be understood that what has been described herein are exemplary arrangement of circuits that are operable in a bandgap configuration and can be used in environments with low supply voltages as there is no need to provide transistors in a cascoded arrangement. Such circuits may provide for simultaneous generation of temperature independent voltage and temperature independent current references. By providing a resistor at the output node of an amplifier it is possible to compensate for base emitter variations in the transistor providing the bandgap voltage cell CTAT component and this compensation can be achieved irrespective of the resistor's temperature coefficient. Such circuits may be configured to provide bias currents to each of the first and second bipolar transistors Q1 and Q2 as to compensate for second order curvature effects that are inherent in any bandgap cell.

It will be understood that what has been described herein are exemplary embodiments of circuits which, by providing a second amplifier and a resistor at the output of a bandgap reference cell it is possible to create a constant current summing node at which PTAT and CTAT currents are summed. In modifications to the circuit it is possible to also provide a voltage reference node corresponding to the signal provided at the summing node. A further modification enables generation of a second voltage reference whose value is related to the base emitter voltage Vbe of a bipolar transistor. Further modifications provided for the generation of curvature correction within the circuit by biasing each of the first and second bipolar transistors Q1 and Q2 with currents of different forms. While the present invention has been described with reference to exemplary arrangements and circuits it will be understood that it is not intended to limit the teaching of the present invention to such arrangements as modifications can be made without departing from the spirit and scope of the present invention. In this way it will be understood that the invention is to be limited only insofar as is deemed necessary in the light of the appended claims.

It will be understood that the use of the term "coupled" is intended to mean that the two devices are configured to be in electric communication with one another. This may be achieved by a direct link between the two devices or may be via one or more intermediary electrical devices.

Similarly the words comprises/comprising when used in the specification are used to specify the presence of stated features, integers, steps or components but do not preclude the presence or addition of one or more additional features, integers, steps, components or groups thereof.

The invention claimed is:

1. A bandgap reference circuit comprising:

a. a first amplifier having an inverting terminal, a non-inverting terminal and an output terminal, b. a second amplifier having an inverting terminal, a non-inverting terminal and an output terminal, c. first and second bipolar transistors operable at different current densities and coupled to the non-inverting and inverting terminals of the first amplifier respectively so as to generate a PTAT current across a first load device coupled to the non-inverting terminal of the first amplifier, d. first and second MOS devices driven by the output of the first amplifier for providing a PTAT current, each MOS device being associated with a corresponding input terminal of the second amplifier, e. a second load device, and wherein the second amplifier is operably coupled to the first amplifier such that the first and second amplifiers share a common node to which a CTAT voltage is applied, the circuit being configured to operably replicate the CTAT voltage across the second load device for generating a CTAT current, the circuit additionally providing a summing node operably coupled to effect a summing of the CTAT and PTAT currents to provide a current output signal.

2. A bandgap reference circuit as claimed in claim 1 wherein the first and second MOS devices which are operably coupled together such that the PTAT current is provided by the drain current of the second MOS device.

3. A bandgap reference circuit as claimed in claim 2, wherein the first MOS device is configured as an inverter.

4. The circuit of claim 2 wherein the second load device is coupled to the inverting input of the second amplifier, and the summing node is common to the second load device, the inverting input of the second amplifier and the drain of the second MOS device.

5. The circuit of claim 2 wherein the drain of the first MOS device is coupled to the non-inverting terminal of the second amplifier.

6. The circuit of claim 2 including a first current mirror coupled to each of the summing node and the inputs to the first amplifier.

7. The circuit of claim 6 wherein the current mirror replicates the current provided at the summing node to bias each of the first and second bipolar transistors.

8. The circuit of claim 7 wherein the current mirror mirrors the summed current to the second bipolar transistor and to a node common to the first load device and the first bipolar transistor.

9. The circuit of claim 2 including a third amplifier having its non-inverting input coupled to the non-inverting input of the second amplifier such that the CTAT voltage at the non-inverting input to the second amplifier is reflected at the non-inverting input of the third amplifier.

10. The circuit of claim 9 wherein the second load device is coupled to the inverting input of the third amplifier, and the summing node is provided between the second load device and the inverting input of the second amplifier.

11. The circuit of claim 10 including a first current mirror coupled to the drain of the second MOS device and configured to mirror the PTAT current provided by the drain current of the second MOS device to bias the first bipolar transistor.

12. The circuit of claim 11 including a load resistor provided between the current mirror and a node common to the first load device and the first bipolar transistor.

13. The circuit of claim 12 including a second current mirror coupled to the summing node and configured to mirror a summed current comprising a PTAT current and a CTAT current from the summing node to bias the second bipolar transistor, such that each of the first and second bipolar transistors are biased with currents of a different form.

14. The circuit of claim 1 including a current mirror coupled to the summing node and configured for mirroring the summed current comprising the PTAT current and the CTAT current across a load device for generating a corresponding reference voltage.

15. The circuit of claim 10 including a curvature correction circuit, the curvature correction circuit operably providing a first biasing current to the first bipolar and a second biasing current to the second bipolar, each of the first and biasing currents differing in their temperature dependency.

16. A bandgap reference circuit including:

a. A first circuit arrangement including a first amplifier of the circuit, the first amplifier having an inverting and a non-inverting input and an output, the first circuit arrangement including a first bipolar transistor operable at a first current density coupled to the inverting input, a second bipolar transistor operable at a second current density coupled to the non-inverting input, a first resistor coupled to the non-inverting node and across which a base emitter voltage difference between the first and second bipolar transistors may be generated, the first circuit arrangement providing at an output of the first amplifier a PTAT voltage, b. A second circuit arrangement having a second amplifier having an inverting and a non-inverting input and an output, the second amplifier being coupled at its non-inverting node to the non-inverting node of the first amplifier such that a CTAT voltage provided at the input of the first amplifier is replicated at each of the inputs of the second amplifier, the output of the second amplifier being coupled to each of the first and second bipolar transistors, the second amplifier being coupled to a second resistor of the circuit to operably generate a CTAT current equivalent to the CTAT voltage;

c. A current summing node provided relative to the first and second circuit arrangements such that the CTAT current and a PTAT current derived from the PTAT voltage of the first circuit arrangement are summed to provide a constant current output of the circuit.

17. A bandgap reference circuit comprising:

a. a first amplifier having an inverting terminal, a non-inverting terminal and an output terminal, b. a second amplifier having an inverting terminal, a non-inverting terminal and an output terminal, c. first and second bipolar transistors operable at different current densities and coupled to the non-inverting and inverting terminals of the first amplifier respectively so as to generate a PTAT current across a first load device coupled to the non-inverting terminal of the first amplifier, d. first and second MOS devices coupled to the output of the first amplifier, the first MOS device being configured as an inverter and the second MOS device being arranged relative to the first MOS device such that the PTAT current generated across the first load device is reflected at the drain current of the second MOS device, the drain of the second MOS device being coupled to the inverting terminal of the second amplifier, e. a second load device, and wherein the second amplifier is operably coupled to the first amplifier such that a CTAT voltage is provided to the input of the second amplifier, the circuit being configured to operably replicate the CTAT voltage across the second load device for generating a CTAT current, the circuit additionally providing a current summing node operably coupled to effect a summing of the CTAT and PTAT currents to provide a current output signal.

18. A bandgap reference circuit comprising:

a. a first amplifier having a first input, a second input and an output, b. a second amplifier having a first input, a second input and an output, c. a first and second semiconductor elements of a first type each associated with a corresponding one of the inputs of the first amplifier, d. a first load element arranged relative to the first and second semiconductor elements such that a PTAT voltage is developed across the first load element, e. a pair of second type semiconductor devices driven by the output of the first amplifier for providing a PTAT current, each second type semiconductor device being associated with a corresponding input of the second amplifier, f. a second load element, and wherein the second amplifier is operably coupled to the first amplifier such that the first and second amplifiers share a common node to which a CTAT voltage is applied, the circuit being configured to operably replicate the CTAT voltage across the second load device for generating a CTAT current, the circuit additionally providing a summing node operably coupled to effect a summing of the CTAT and PTAT currents to provide a current output signal.

* * * * *